US006947693B2

(12) United States Patent
Kamiya et al.

(10) Patent No.: US 6,947,693 B2
(45) Date of Patent: Sep. 20, 2005

(54) IMAGE FORMING APPARATUS INCLUDING ROTARY MEMBER SPEED DETECTION MECHANISM

(75) Inventors: Takuroh Kamiya, Tokyo-to (JP); Junya Takigawa, Tokyo-to (JP); Yoshihiro Sakai, Tokyo-to (JP); Katsuya Kawagoe, Tokyo-to (JP); Ryuuichi Mimbu, Kawasaki (JP); Toshiyuki Andoh, Kanagawa-ken (JP); Koichi Kudo, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 65 days.

(21) Appl. No.: 10/456,469

(22) Filed: Jun. 9, 2003

(65) Prior Publication Data

US 2004/0228663 A1 Nov. 18, 2004

(30) Foreign Application Priority Data

Jul. 29, 2002 (JP) ..... 2002-220497

(51) Int. Cl.[7] ..... G03G 15/01
(52) U.S. Cl. ..... 399/301; 399/302
(58) Field of Search ..... 399/297, 298, 399/299, 301, 302

(56) References Cited

U.S. PATENT DOCUMENTS

| | | | | |
|---|---|---|---|---|
| 4,788,572 A | * | 11/1988 | Slayton et al. | 399/301 |
| 5,584,475 A | | 12/1996 | Asada et al. | |
| 2002/0060397 A1 | | 5/2002 | Kndo | |

FOREIGN PATENT DOCUMENTS

| | | | |
|---|---|---|---|
| EP | 0 994 052 | | 4/2000 |
| EP | 1 179 498 | | 2/2002 |
| JP | 11-24507 | | 1/1999 |
| JP | 11-024507 | * | 1/1999 |
| WO | WO 94/01495 | | 1/1994 |

* cited by examiner

*Primary Examiner*—Hoang Ngo
(74) *Attorney, Agent, or Firm*—Oblon, Spivak, McClelland, Maier & Neustadt, P.C.

(57) ABSTRACT

An image forming apparatus including a rotary member having an image formation area, and a scale located at a position outside of the image formation area and on an inner circumference of the rotary member. Also included is a drive device configured to drive the rotary member, a developing device configured to develop an image on the image formation area of the rotary member, and a transfer device configured to transfer the image on the image formation area to a recording sheet. Further included is a sensor configured to detect the scale on the rotary member and to output a signal corresponding to the detection of the scale.

27 Claims, 6 Drawing Sheets

IMAGE FORMING APPARATUS INCLUDING ROTARY MEMBER SPEED DETECTION MECHANISM

PROCESS REFERENCE TO A RELATED APPLICATION

The present application claims priority to Japanese Patent Application No. 2002-220497 filed on Jul. 29, 2002, which is incorporated in its entirety.

BACKGROUND OF THE INVENTION

1. Field of the Invention

The present invention relates to an image forming apparatus such as a copier, a facsimile machine, a printer, etc., including a detection mechanism for precisely measuring the speed of a rotary member such as a transfer belt.

2. Description of the Background

A color copier or printer generally includes a plurality of developing devices surrounding a photo conductor (i.e., a single drum type apparatus) or a single developing device around a single photoconductor (i.e., a tandem type apparatus). The single drum type apparatus is advantageous because it is smaller, thereby reducing the overall cost of the apparatus. On the other hand, the tandem type apparatus is advantageous because the printing speed is faster.

Accordingly, the tandem type apparatus has recently been used especially because the printer market is demanding the printing speed of color copiers be the same as monochromatic copiers.

In addition, the tandem type apparatus includes two types. A first type is called a direct transfer type in which a toner on a photoconductor is transferred to a sheet conveyed by a transfer belt. The second type is called an indirect transfer type in which a toner on a transfer belt is transferred to a sheet by a second transfer device. However, both types of devices have a same problem in properly overlaying images to provide a color copy.

Therefore, an image forming apparatus must precisely determine and control the speed of the rotary member such as a transfer belt, a conveying belt, etc., to precisely overlay plural images. For example, Japanese Patent Laid-Open No. 11-024507 (JP '507) discloses a device that determines a speed of the rotary member by detecting a scale on the rotary member. However, in this publication, the location of the scale is in a position in which image transfer occurs. Therefore, the scale negatively affects the image transfer. JP '507 is also incorporated in its entirety.

SUMMARY OF THE INVENTION

Accordingly, one object of the present invention is to solve the above-noted and other problems.

Another object of the present invention is to provide a novel image forming apparatus that precisely detects the speed of the rotary member without negatively affecting the image transfer.

To achieve these and other objects, the present invention provides an image forming apparatus including a rotary member having an image formation area and a scale located at a position outside of the image formation area and on an inner circumference of the rotary member. The apparatus also includes a drive device configured to drive the rotary member, a developing device configured to develop an image on the image formation area, a transfer device configured to transfer the image on the image formation area to a recording sheet, and a sensor configured to detect the scale on the rotary member and to output a signal corresponding to the detection of the scale. The present invention also provides a novel image forming method.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
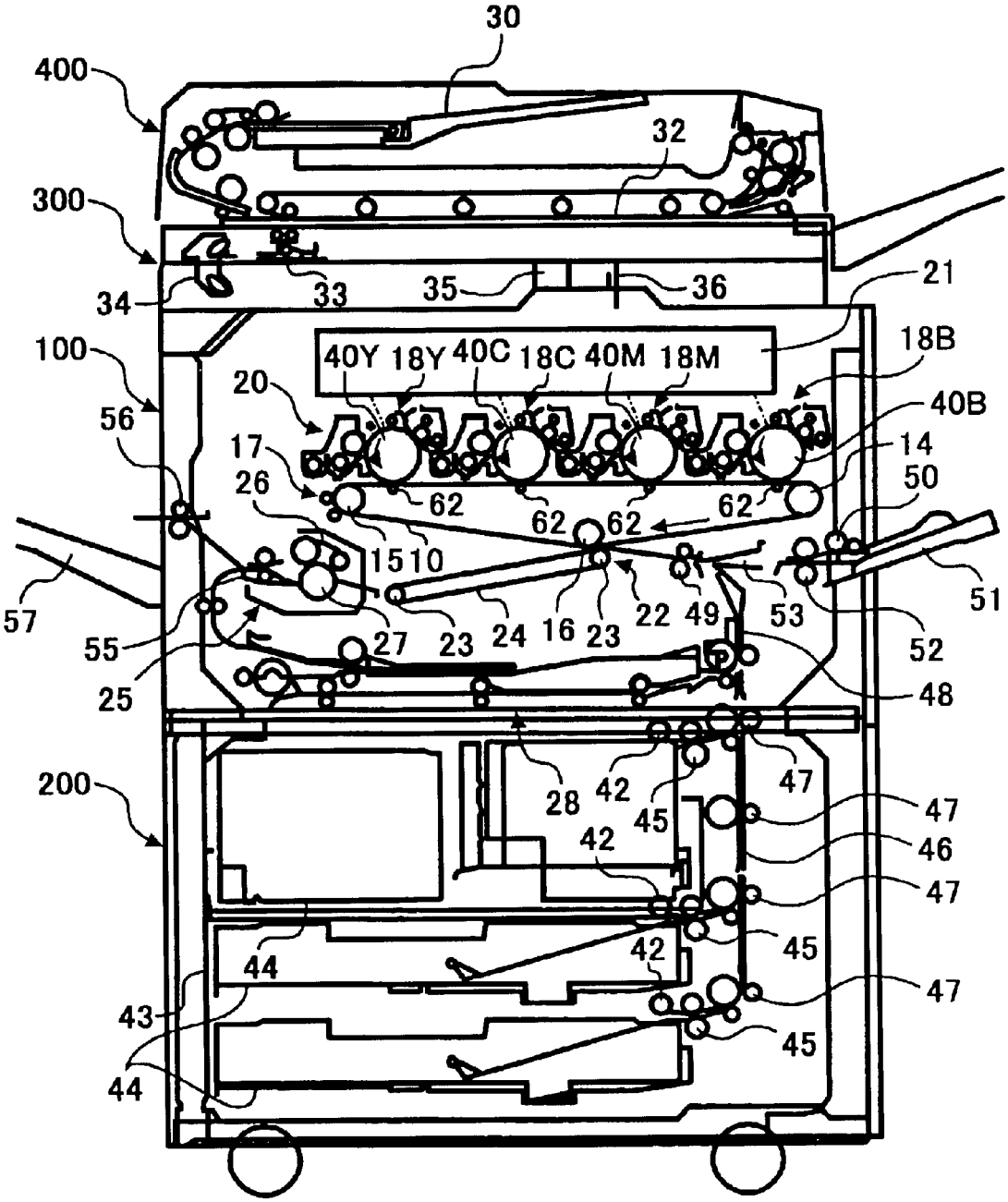
FIG. 1 is a schematic of a color image forming apparatus.

Referring now to the drawings, wherein like reference numerals designate identical or corresponding parts throughout the several views, the present invention will be described.

FIG. 1 illustrates a color image forming apparatus including a main body 100, a paper feeding device 200, a scanner 300 and an automatic document feeder (ADF) 400. Further, as shown, an intermediate transfer belt 10 as a rotary member is centrally arranged in the main body 100. The intermediate transfer belt 10 is stretched between rollers 14, 15 and 16. The roller 14 is also connected to a motor (not shown) which drives the roller 14 so that the intermediate transfer belt 10 rotates in a clockwise direction as indicated by the arrow.

The image forming apparatus also includes a cleaning device 17 for removing toner remaining on the transfer belt 10. As shown, the cleaning device 17 is disposed upstream of the roller 16. Further, tandem image forming components 20 including yellow, cyan, magenta and black colors are disposed above the intermediate transfer belt 10. Further, each photoconductor 40Y, 40C, 40M, 40B of the tandem image components 20 has a charging device, a developing device, a first transfer device 62, a cleaning device for the respective photoconductor, and a discharging device. Note the order of the colors shown in FIG. 1 (i.e., Y, C, M and B) is only an example and any other order may be used.

In addition, the transfer belt 10 includes a base layer, an elastic layer and a coating layer in this order. The base layer may be made from fluoric resin or from laminated materials such as canvas. The elastic layer may include fluorine rubber and the coating layer may be made from smooth materials such as fluoric resin, for example.

Also shown is an exposure device 21 disposed above the tandem image components 20, and a second transfer device 22 disposed under the transfer belt 10. A second transfer belt 24 is also stretched between rollers 23. The apparatus also includes a fixing device 25 having a pressure roller 27 and a friction roller 26 disposed next to the second transfer belt 24. The pressure roller 27 presses against the fixing roller 26 such that an image formed on the belt 24 is fixed to a sheet of paper passed therethrough.

The second transfer device 22 conveys a sheet to the fixing device 25. Alternatively, rather than the second transfer device 22, a transfer roller and a non-contact charger may be used to convey the sheet. Also shown in FIG. 1 is a duplex device 28 disposed under the transfer device 22 and the fixing device 25.

An operation of the apparatus will now be described. At first, a manuscript is set on a manuscript tray 30 of the ADF 400. Alternatively, the ADF 400 may be opened and the manuscript set on a contact glass 32. When the apparatus is started, the manuscript in the ADF 400 is conveyed and the optical light source 33 and mirror 34 are appropriately operated to read the image on the manuscript. Light emitted from a light source included in the optical light source 33 is reflected by the mirror 34 to an optical member 34, which then focuses the light through a lens 35 into a sensor 36.

Further, each photoconductor 40Y, 40C, 40M, 40B rotates and the charging devices charge each respective photoconductor. The reflected light is also emitted towards each photoconductor 40Y, 40C, 40M, 40B based on the image read by the scanner 300, and using a toner included in each developing device, an image is formed on each photoconductor. As noted above, when the rollers 14, 15, 16 rotate, the transfer belt 10 also rotates. Then, each image from the photoconductors 40Y, 40C, 40M and 40B transfers to the transfer belt 10 using the first transfer devices 62. The cleaning device 17 cleans the toner remaining on the transfer belt 10. The discharging device then discharges the photoconductors.

After a paper feeding roller 42 included in the paper feeding device 200 rotates, a separation roller 45 separates a top sheet from an appropriate one of paper feeding cassettes 44 of a paper bank 43. The sheet then merges into a paper feeding path 46, and a conveyance roller 47 conveys the sheet toward a paper feeding pass 48 to a registration roller 49.

Alternatively, the sheet may be inserted via a manual feed tray 51. A roller 50 then conveys the sheet placed on the manual feed tray 51 to the registration roller 49. Further, the registration roller 49 conveys the paper between the intermediate transfer belt 10 and the second transfer device 22. Then, the second transfer device 22 conveys the sheet to the fixing device 25, and after the fixing device 25 fixes the image onto the sheet, the sheet is guided by a reshuffling member 55 toward a discharge roller 56. The discharge roller 56 then discharges the sheet to an eject tray 57.

Further, when a duplex mode is selected, the sheet is transferred to the duplex device 28 by the reshuffling member 55, which turns the sheet over for duplex printing. Then, an image on the back of the manuscript is formed on the back of the sheet.

In this image forming process, the intermediate transfer belt 10 is precisely driven to ensure each image is properly overlapped with a previous image (i.e., to form a color image). However, the axis of some of the rollers 14, 15, 16, etc., does not always directly coincide with the center of the roller. Accordingly, the actual speed of the rollers and hence the actual speed of the transfer belt 10 does not necessarily correspond with the desired speed of the transfer belt 10 to precisely overlay images. The material of the rollers, the belt 10 shifting on the rollers, etc., also affects the actual speed of the transfer belt 10.

Therefore, the present invention provides a rotary member including an image formation area, and a scale located at a position outside of the image formation area and on an inner circumference of the rotary member. Also provided is a sensor configured to detect the scale on the rotary member and to output a signal corresponding to the detection of the scale. In more detail, FIG. 2 is a schematic illustrating a scale 70 located at a position outside of the image formation area and on an inner circumference of the transfer belt 10 and a sensor 71 configured to detect the scale 70 on the transfer belt 10 and to output a signal corresponding to the detection of the scale 70.

Figure 2:
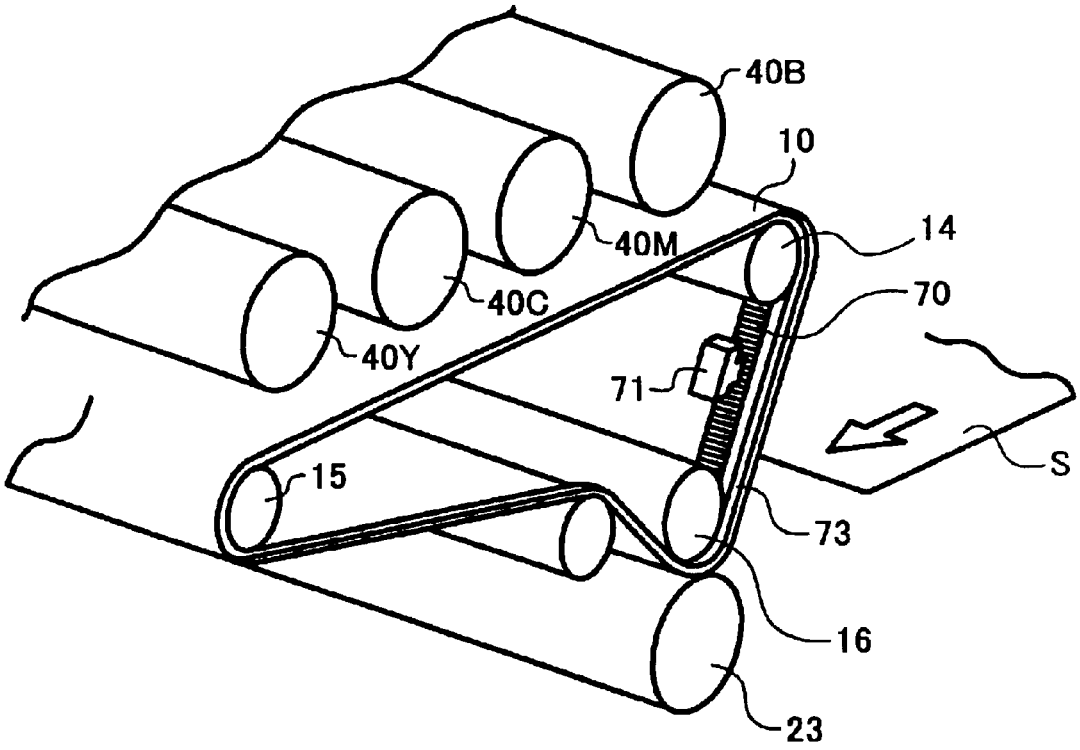
FIG. 2 is a schematic illustrating the position of the scale on a transfer belt and the position of the corresponding sensor according to the present invention.

As shown in FIG. 2, the scale includes a plurality of concave and convex portions. Thus, the sensor 71 can detect whether a concave or convex portion is detected via a difference in reflected light, for example.

Figure 3:
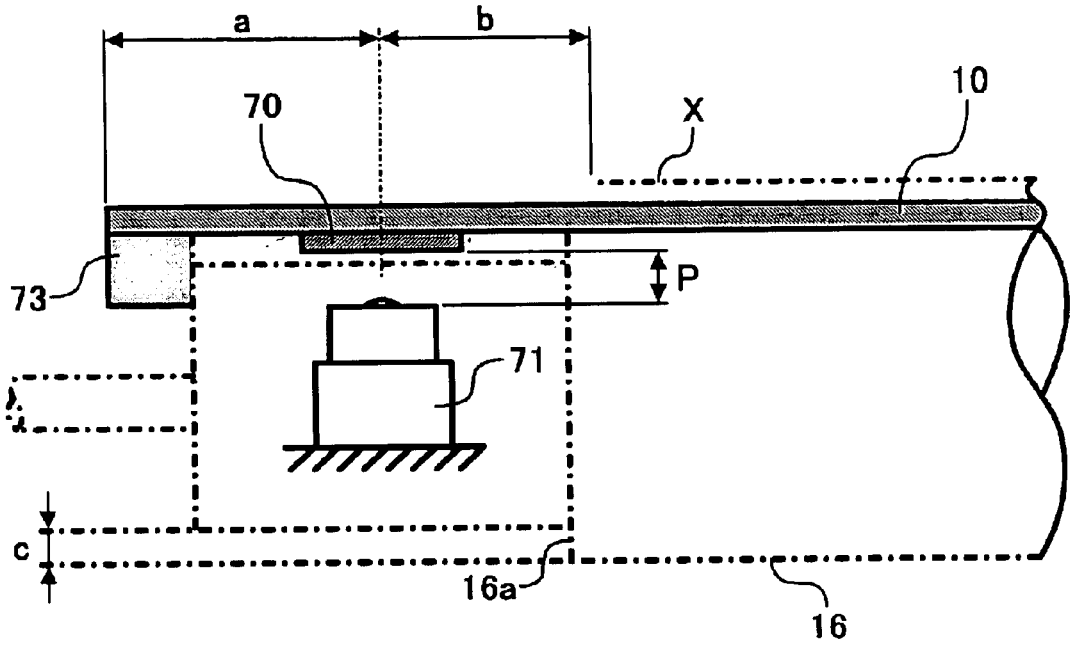
FIG. 3 is a fragmentary sectional diagram showing in more detail the position of the scale on the transfer belt and the corresponding sensor.

As shown in FIG. 3, the scale 70 is located at a distant "b" from one edge of an image forming effective area "X" on the transfer belt 10. Further, the scale 70 is located at a distant "a" from an edge of the transfer belt 10. In addition, the scale 70 is formed on an inner circumference of the transfer belt 10.

Also, a reading gap "P" exists between the sensor 71 and the scale 70. The sensor 71 is also disposed between the rollers 14 and 16. Therefore, the scale 70 does not negatively affect image transfer, because the scale 70 is located outside of the image formation area and on an inner circumference of the transfer belt 10. Further, the location of the scale 70 is advantageous because there is generally more room on an inside of the transfer belt 10 and this is generally cleaner than areas outside of the belt 10. The same is true for the sensor 71. In addition, edges of the intermediate transfer belt 10 may buckle or heave due to the tension applied to the intermediate transfer belt 10 by the rollers 14, 15, 16. However, this negative influence is avoided, because the sensor 71 and scale 70 are arranged at a predetermined distance from the belt edge.

FIGS. 2 and 3 also illustrate the transfer belt 10 including a regulating member 73 to prevent the belt 10 from shifting on the rollers. Note the rollers 14, 15, 16 rotate inside of the regulating member 73. Further, as shown in FIG. 3, the rollers 14, 15, 16 include a concave part 16*a* which allows the scale 70 to pass within the concave portion 16*a* without the scale 70 contacting the roller. This prevents the scale 70 from being damaged by one of the rollers 14, 15, 16. Note that the scale 70 and the sensor 71 may be an optical or magnetic type of device.

Figure 4:
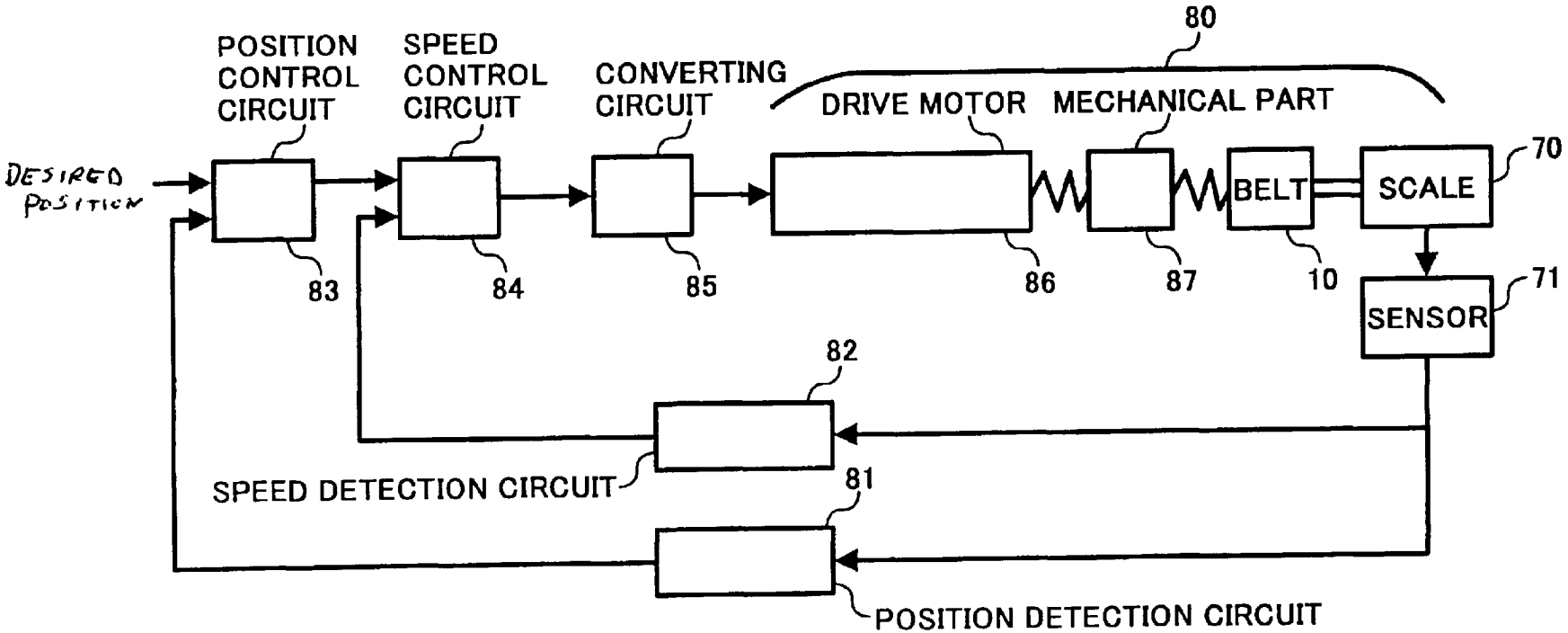
FIG. 4 is a block diagram illustrating a feedback control device according to the present invention.

The present invention also includes a feedback control device as shown in FIG. 4, which is used to precisely control the speed of the image transfer belt 10. As shown, the feedback control device includes a position detection circuit 81 and a speed detection circuit 82. The position detection circuit 81 converts a signal output from the sensor 71 into a position signal, and the speed detection circuit 82 converts a signal output from the sensor 71 into a speed signal. The position signal corresponds to a position of the scale 70, and the speed signal corresponds to an actual speed of the belt 10.

Further, FIG. 4 illustrates a drive motor 86, a mechanical part 47 (such as the rollers 14, 15, 16), and the intermediate transfer belt 10 designated as a control target 80. That is, the control target 80 may be controlled based on the feedback control method shown in FIG. 4.

FIG. 4 also illustrates a position control circuit 83, a speed control circuit 84 and a converting circuit 84. The position control circuit 83 calculates what speed the rollers should be rotated at to offset a desired position and an actual position of the scale 70. That is, the position control circuit 83 includes an inputted desired position and an inputted actual position (detected by the sensor 71). Note the actual position of the scale 70 does not always coincide with the desired position of the scale 70. To correct this offset, the control circuit 83 determines the required increase or decrease in speed the rollers must be rotated at. The speed control circuit 84 receives the calculated speed from the position control circuit 84 and the actual speed detected by the sensor 71 from the speed detection circuit 82. Thus, using these values, the speed control circuit 84 can calculate how to adjust the speed of the rollers. The speed control circuit 84 outputs the calculated adjusted speed value to the converting circuit 85, which converts this signal into an appropriate electrical driving signal used to drive the motor associated with the driver roller. Accordingly, the speed of the transfer belt 10 can be precisely controlled.

Thus, even though the transfer belt 10 may slide or shift due to the friction of the rollers 14, 15, 16, the axis of the roller does not precisely coincide with the center of the roller, etc., the sensor 71 still detects the actual speed of the transfer belt 10.

Figure 5:
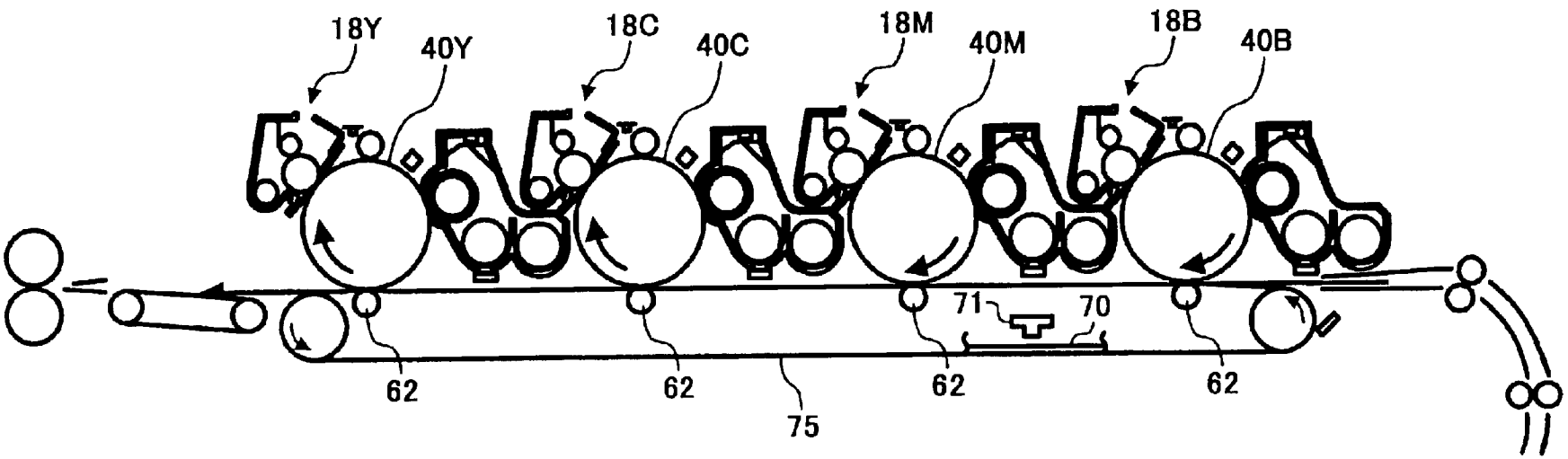
FIG. 5 is a schematic diagram of the present invention applied to a tandem type apparatus.

The present invention also applies to another type of image forming apparatus such as the tandem direct transfer type image forming apparatus. As shown in FIG. 5, this image forming apparatus has image forming parts 18Y, 18C, 18M, 18B, photoconductors 40Y, 40C, 40M, 40B, a conveyance belt 75 and a transfer device 62 for each photoconductor. As shown, the scale 70 is disposed on the inner circumference side of the conveyance belt 75 and a sensor 71 for detecting the scale 70 is disposed inside of the conveyance belt 75.

Figure 6:
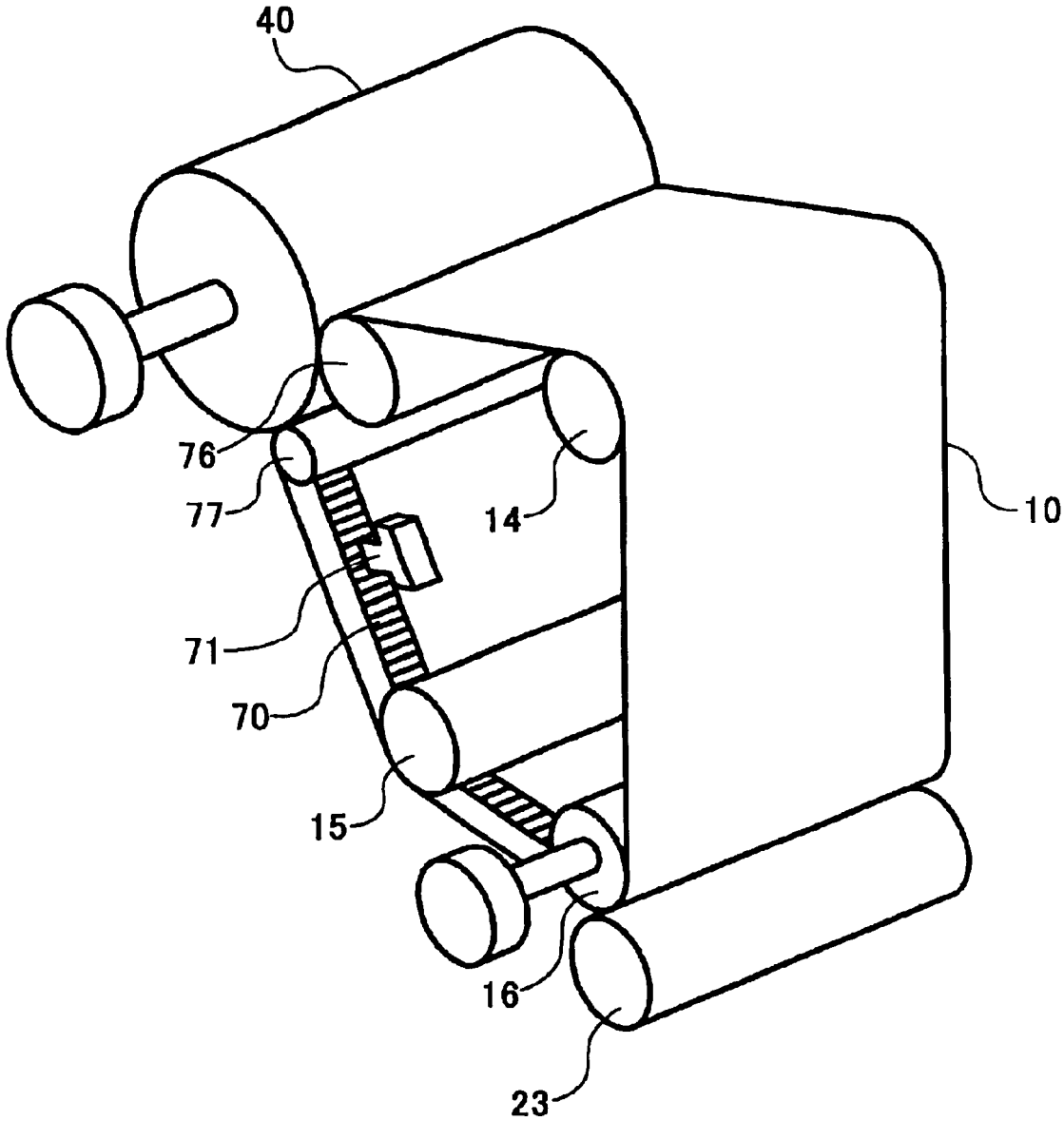
FIG. 6 is a schematic diagram of the present invention applied to an indirect tandem type apparatus.

The present invention may also be applied to an image forming apparatus including an indirect transfer type image forming apparatus, as shown in FIG. 6, for example. In more detail, FIG. 6 illustrates an image forming apparatus having the transfer belt 10 stretched by rollers 14, 15, 16, 76, 77, a photoconductor 40, and a transfer roller 23. As shown, the scale 70 is disposed on the inner circumference of the conveyance belt 75, and the sensor 71 for detecting the scale 70 is disposed inside of the conveyance belt 75.

Note that in the apparatus as shown in FIGS. 5 and 6, the intermediate transfer belt and conveyance belt are used. However, a drum-shaped intermediate transfer member and a drum-shaped conveyance member may also be in use instead of the belt. Also, a drum-shaped photoconductor and a belt-shaped photoconductor can be used instead of the intermediate transfer members and the conveyance members.

Obviously, numerous modifications and variations of the present invention are possible in light of the above teachings. It is therefore to be understood that within the scope of the appended claims, the invention may be practiced otherwise than as specifically described herein.

What is claimed is:

1. An image forming apparatus, comprising:

a rotary member including, an image formation area, and a scale located at a position outside of the image formation area on an inner circumference of the rotary member and closer to an edge of the rotary member than to the center of the rotary member;

a drive device configured to drive the rotary member and including a gap substantially open to the rotary member and substantially open in the axial direction of the drive device;

a developing device configured to develop an image on the image formation area of the rotary member;

a transfer device configured to transfer the image on the image formation area to a recording sheet; and a sensor configured to detect the scale on the rotary member and to output a signal corresponding to the detection of the scale.

2. The image forming apparatus according to claim 1, further comprising:

a control device control including, a position detection circuit configured to convert the signal output from the sensor into a position signal corresponding to a position of the scale on the rotary member, and a speed detection circuit configured to convert the signal output from the sensor into a speed signal corresponding to a speed of the rotary member.

3. The image forming apparatus according to claim 2, wherein the control device controls the drive device to adjust the speed of the rotary member based on the speed of the rotary member detected by the speed detection circuit and the position of the scale detected by the position detection circuit.

4. The image forming apparatus according to claim 1, wherein the position of the scale is located at an inside of an edge of the rotary member on the inner circumference of the rotary member.

5. The image forming apparatus according to claim 1, wherein the rotary member includes one of a transfer belt, a conveyance belt, an intermediate transfer belt and a drum-shaped transfer member.

6. The image forming apparatus according to claim 1, wherein the sensor is disposed on the internal circumference of the rotary member.

7. The image forming apparatus according to claim 1, wherein the drive device includes a plurality of rollers configured to rotate the rotary member, and wherein the sensor is disposed on the internal circumference of the rotary member between two of the plurality of rollers.

8. The image forming apparatus according to claim 1, wherein the drive member includes a concave portion and the scale passes within the concave portion such that the scale does not contact the rotary member.

9. The image forming apparatus according to claim 1, wherein the sensor is one of a magnetic sensor and an optical sensor.

10. An image forming system, comprising:

rotary means for forming an image and including, an image formation area, and a scale located at a position outside of the image formation area and on an inner circumference of the rotary means and closer to an edge of the rotary means than to the center of the rotary means;

drive means for driving the rotary means including a gap substantially open to the rotary means and substantially open in the axial direction of the drive means;

developing means for developing an image on the image formation area of the rotary means;

transfer means for transferring the image on the image formation area to a recording sheet; and sensor means for detecting the scale on the rotary means and for outputting a signal corresponding to the detection of the scale.

11. The image forming system according to claim 10, further comprising:

control means for controlling the drive means and including, position detection means for converting the signal output from the sensor means into a position signal corresponding to a position of the scale on the rotary means, and speed detection means for converting the signal output from the sensor means into a speed signal corresponding to a speed of the rotary means.

12. The image forming system according to claim 11, wherein the control means controls the drive means to adjust the speed of the rotary means based on the speed of the rotary means detected by the speed detection means and the position of the scale detected by the position detection means.

13. The image forming system according to claim 10, wherein the position of the scale is located at an inside of an edge of the rotary means on the inner circumference of the rotary means.

14. The image forming system according to claim 10, wherein the rotary means includes one of a transfer belt, a conveyance belt, an intermediate transfer belt and a drum-shaped transfer member.

15. The image forming system according to claim 10, wherein the sensor means is disposed on the internal circumference of the rotary member.

16. The image forming system according to claim 10, wherein the drive means includes a plurality of rollers for rotating the rotary means, and wherein the sensor means is disposed on the internal circumference of the rotary means between two of the plurality of rollers.

17. The image forming system according to claim 10, wherein the drive means includes a concave portion and the scale passes within the concave portion such that the scale does not contact the rotary means.

18. The image forming system according to claim 10, wherein the sensor means is one of a magnetic sensor and an optical sensor.

19. An image forming method, comprising:

forming an image with a rotary member, said rotary member including, an image formation area, and a scale located at a position outside of the image formation area and on an inner circumference of the rotary member and closer to an edge of the rotary member than to the center of the rotary member;

driving the rotary member and including a gap substantially open to the rotary member and substantially open in the axial direction of the rotary member;

developing an image on the image formation area of the rotary member;

transferring the image on the image formation area to a recording sheet; and detecting the scale on the rotary member and outputting a signal corresponding to the detection of the scale.

20. The image forming method according to claim 19, further comprising:

converting the signal corresponding to the detection of the scale into a position signal corresponding to a position of the scale on the rotary member; and converting the signal corresponding to the detection of the scale into a speed signal corresponding to a speed of the rotary member.

21. The image forming method according to claim 20, further comprising:

adjusting the speed of the rotary member based on the speed and the position of the rotary member.

22. The image forming method according to claim 19, further comprising:

positioning the scale at an inside of an edge of the rotary member on the inner circumference of the rotary member.

23. The image forming method according to claim 19, wherein the rotary member includes one of a transfer belt, a conveyance belt, an intermediate transfer belt and a drum-shaped transfer member.

24. The image forming method according to claim 19, wherein the scale is detected via a sensor disposed on the internal circumference of the rotary member.

25. The image forming method according to claim 19, wherein the rotary member is driven by a plurality of rollers, and wherein the scale is detected via a sensor disposed on the internal circumference of the rotary member between two of the plurality of rollers.

26. The image forming method according to claim 19, wherein the rotary member is driven by a plurality of rollers each including a concave portion and the scale passes within the concave portion such that the scale does not contact the rotary member.

27. The image forming method according to claim 19, wherein scale is detected via a sensor that is one of a magnetic sensor and an optical sensor.

* * * * *